US007088048B2

(12) United States Patent
Martin et al.

(10) Patent No.: US 7,088,048 B2
(45) Date of Patent: Aug. 8, 2006

(54) DEVICE AND PROCESS FOR SWITCHING AND CONTROLLING AN ELECTRON DOSE EMITTED BY A MICRO-EMITTER

(75) Inventors: Jean-Luc Martin, St Geoire en Valdaine (FR); Claude Bieth, Claix (FR); Nicolas Delorme, Grenoble (FR)

(73) Assignee: Commissariat a l'Energie Atomique, Paris (FR)

( * ) Notice: Subject to any disclaimer, the term of this patent is extended or adjusted under 35 U.S.C. 154(b) by 134 days.

(21) Appl. No.: 10/790,704

(22) Filed: Mar. 3, 2004

(65) Prior Publication Data

US 2004/0222391 A1 Nov. 11, 2004

(30) Foreign Application Priority Data

Mar. 27, 2003 (FR) ..... 03 50071

(51) Int. Cl.
*H05B 39/00* (2006.01)
*G21G 4/00* (2006.01)

(52) U.S. Cl. ..... 315/160; 315/169.3; 315/167; 315/3.6; 315/169.1; 315/111.91; 315/337; 250/493.1

(58) Field of Classification Search ..... 315/160, 315/167, 169.3, 169.1, 111.91, 337, 340, 315/111.21; 250/493.1
See application file for complete search history.

(56) References Cited

U.S. PATENT DOCUMENTS 3,936,756 A 2/1976 Someya et al. ..... 315/107
5,656,892 A 8/1997 Zimlich et al. ..... 315/169.3
6,040,973 A 3/2000 Okamoto et al. ..... 361/235
6,060,840 A 5/2000 Foo et al. ..... 315/169.1
6,163,107 A 12/2000 Itoh et al. ..... 313/495
6,362,574 B1 * 3/2002 Aguero et al. ..... 315/169.3
6,498,349 B1 12/2002 Thomas et al. ..... 250/398
6,577,130 B1 * 6/2003 Adamo et al. ..... 324/348
2004/0183456 A1 * 9/2004 Hoffmann ..... 315/160

FOREIGN PATENT DOCUMENTS

EP 1 104 002 5/2001
EP 1 225 613 7/2002

OTHER PUBLICATIONS

M. Nagao, et al., Asia Display / IDW' 01, vol. conf. 21/8, pp. 1161–1164, XP–001134242, Si Feas Integrated with Driving Circuits for Display–on–a–Chip, Oct. 16, 2001.

* cited by examiner

*Primary Examiner*—Tho Phan
*Assistant Examiner*—Chuc Tran
(74) *Attorney, Agent, or Firm*—Oblon, Spivak, McClelland, Maier & Neustadt, P.C.

(57) ABSTRACT

This invention relates to a device for switching and controlling an electron dose emitted by a micro-emitter comprising a sensor module (30) that receives the output current from the micro-emitter and a voltage to adjust the polarization point of the said device, a comparator module that receives a threshold voltage to adjust the quantity of charges to be emitted, a logical module to initialize the electron emission, and to define whether or not the micro-emitter should emit, a control module that generates the voltages necessary for initialization and extinction of the micro-emitter current pulse, means of varying the threshold voltage.

11 Claims, 7 Drawing Sheets

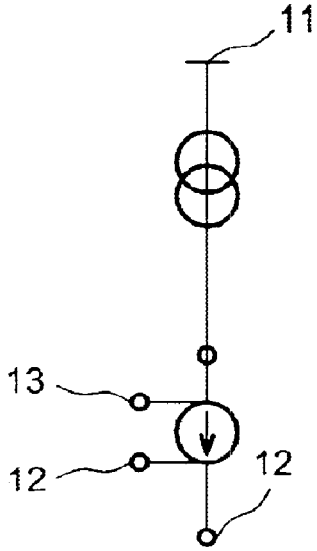
FIG. 1A
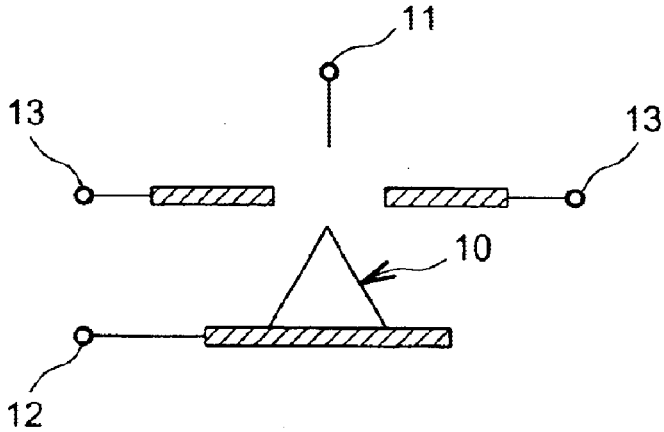
FIG. 1B
FIG. 2
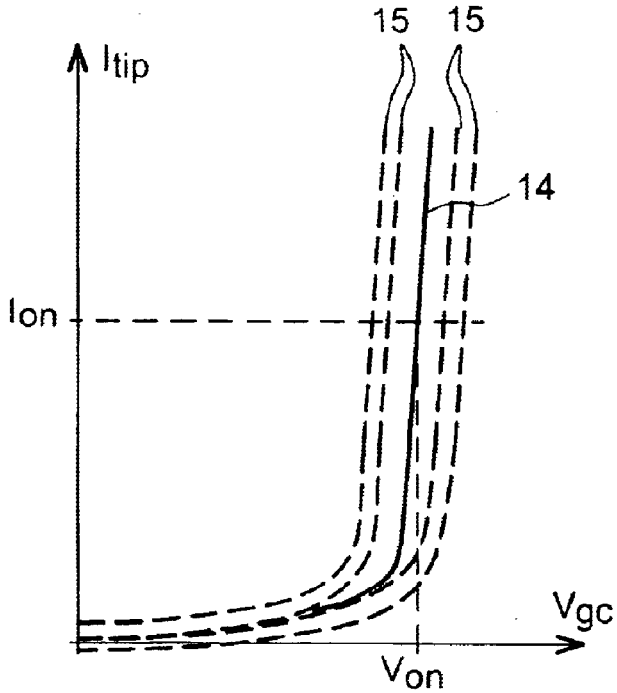

FIG. 13A
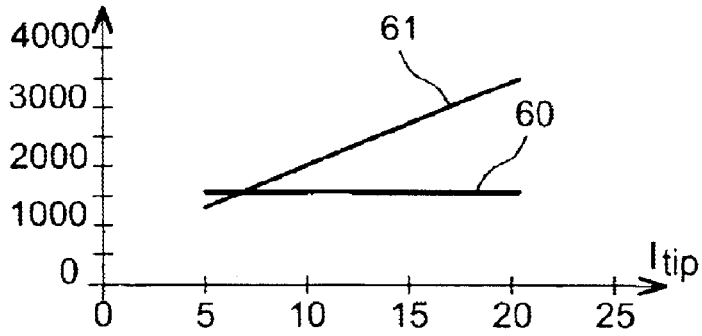
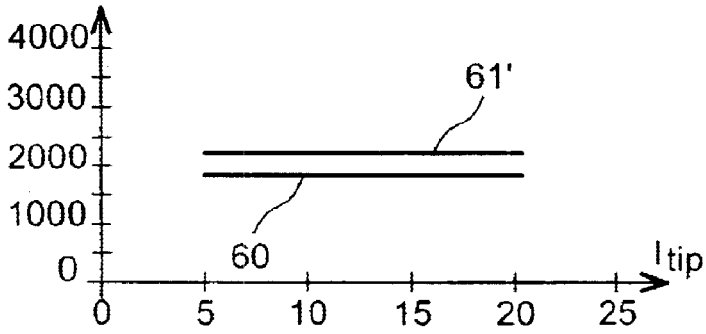
FIG. 13B
FIG. 14
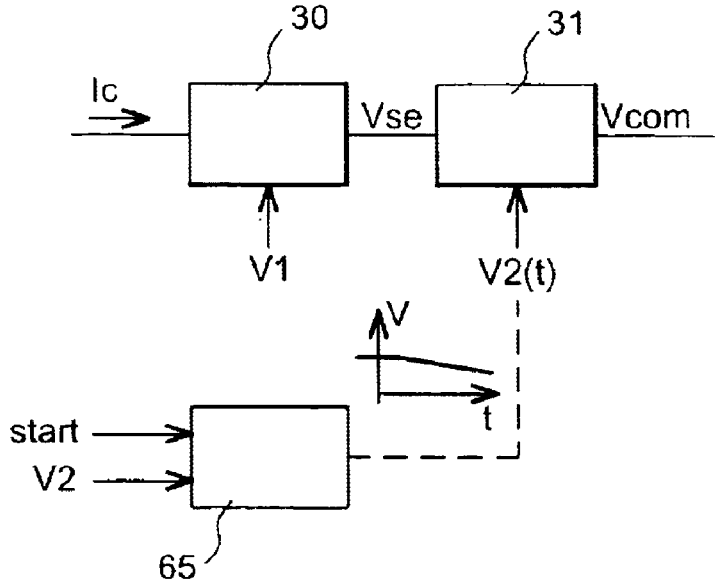

DEVICE AND PROCESS FOR SWITCHING AND CONTROLLING AN ELECTRON DOSE EMITTED BY A MICRO-EMITTER

TECHNICAL FIELD

This invention relates to a device and process for switching and controlling an electron dose emitted by a micro-emitter, for example a microtip.

STATE OF PRIOR ART

Microtip type micro-emitters will be considered in the remainder of the description, as a non-restrictive example.

The subject of microtips, now accompanied by the subject of nanotubes, defines a range of applications for FED (Field Emission Display) displays and also for micro-emitters, in which requirements in terms of switching and controlling of emitted flows are very severe.

In the case of a hot emission (diodes, triodes, cathode ray tubes), electrons acquire sufficient energy (called "output work") due to their thermal agitation to go beyond the potential barrier that retains them to nuclei. They are then moved towards the material surface and, if there is an electric field that attracts them, they can be extracted from this material. At ordinary temperatures, the thermal agitation energy is not sufficient for electrons to exit from the material.

In the case of a cold emission, based on the principle of a field effect test in a vacuum chamber, a tunnel effect enables electrons to be extracted from the emitter (cathode) in the vacuum and then to be collected on an anode. Emitters working in cold emission are considered as being voltage controlled current sources, the flow of emitted electrons obeying Fowler-Nordheim equations.

For example, this is the case of a microtip 10 made of Tungsten used as an electron emitter. Its electrical scheme is shown in FIG. 1A. An electron flow is set up between the anode 11 and the cathode 12. A control voltage is applied between the extraction grid 13 called the "gate", and the cathode 12. FIG. 1B shows the behavioral symbol of such a microtip 10 that can be used with a generic electrical simulator ("Spice" type)

The emission condition for such a microtip 10 is characterized by strong non-linearity of the emission current $I_{tip}$ as a function of the voltage applied on the extraction grid 13. The tip current $I_{tip}$ satisfies the law:

$$I_{tip}=a_{fn}V^2\exp^{-b_{fn}/V_{gc}}$$

The coefficients $a_{fn}$ and $b_{fn}$ depend on the geometric characteristics of the microtip. One such current-voltage characteristic is illustrated in FIG. 2. An example of an operating point ($I_{tip}=I_{on}$ for $V_{gate-cathode}=V_{on}$) is shown in this figure. The ideal characteristic is shown as reference 14.

In reality, this type of characteristic cannot be reproduced from one microtip to another. The result is curves 15 shown in dashed lines.

Therefore one of the disadvantages of cold emission is to reveal some instability in the value of the current, which is equivalent to a noise generated by output working fluctuations inherent to local surface contaminations. These fluctuations are variable from one microtip to another and are also variable in time for the same microtip.

There are two possible types of microtip control:

a current control by a current regulation device: this type of possibility is used in FEDs (Field Emission Display) through a single or "multigate" transistor located in series in the cathode circuit, as described in document references [1] and [2] at the end of the description. The current emitted by each microtip may be programmed theoretically. It is independent of the quality and characteristics of each microtip. The voltage $V_{gc}$ is modulated from one microtip to another or in time. One of the defects of such a control is that it mixes a low voltage (LV) and a high voltage (HV) at the transistor switching and controlling circuit, because the extraction electrode must be increased to a few tens of Volts. The visual display matches the limited operating precision frequency of this type of control.

a voltage control: if care is not taken, the emission current will be modulated which may be unacceptable for some applications. If the current excursion and particularly the extreme values are known, and if the quantity to be controlled is the electric charge, this type of solution is satisfactory when it is combined with a variable observation time window, $T_{nom}$.

$$Q = I_{nom} * T_{nom} = 2I_{nom} * \frac{T_{nom}}{2} = \frac{I_{nom}}{2} * 2T_{nom}$$

The device according to the invention is a circuit of this type that is naturally faster and in which the observed linearity defects are corrected, the extraction grid HV control circuits being independent of the LV circuits controlling the electric charge, which simplifies use of the circuit and reduces the sensitivity to noise.

Therefore several solutions are possible to measure the quantity of electrons transmitted by a microtip. In some cases, it is possible to work in current regulation as illustrated in FIGS. 3A and 3B. Emission of a calibrated current (generator 16) for a given time delimits an electric charge according to the law Q=T.t. This type of current regulation system includes a sensitive tip current detection element 17, a reference current test element 18 and a current adjustment element 19. This system may operate:

In open loop in the case of a sequential calibration, then programming of a given number of measurements with a single reference, as illustrated in FIG. 3A, In closed loop in the case of a current servocontrol in real time as illustrated in FIG. 3B, and as described in document reference [3].

In the embodiment illustrated in FIG. 3A, the specification for the system must allow the necessary time to perform the calibrations. This type of implementation is incapable of correcting imperfections in the electron beam for which the recurrence frequency is higher than the calibration refreshment frequency.

In the embodiment shown in FIG. 3B, the stability of the counter-reaction loop is essential and it must be guaranteed, usually at the price of active compensation of the pass band of the looped system and therefore to the detriment of its speed performances.

Requirements in terms of speed, stability, noise and linearity make it impossible to use this type of implementation in many applications.

A global method of controlling weak electric charges consists of defining the required quantity of charges, interrupting the electron beam when the required dose has been reached ("dose control"), using several configuration input variables. In this case, the quantity of electric charges is defined in advance. The device used for this control must operate on a tip current dynamic, particularly including current fluctuations in time for the same microtip. Theoretically, this type of method enables very good linearity. However, the use of real functional modules and the requirement for high frequency operation result in strong non-linearities in the electric charge controlled as a function of the current state.

A document reference [4] according to known art mentioned at the end of the description describes a two-dimensional network of miniature cathodes used as electron beam emitters that are numerically addressable. This network includes internal electron focusing for each emitter, a closed loop electron dose control circuit for controlling each emitter by precisely controlling the electron flow. This type of dose control circuit connected to an emitter can be used to obtain a dose delivered during each cycle write, adapted despite emitter-to-emitter mismatch, temperature and ageing effects. This control circuit terminates the emission at a fixed dose rather than at a fixed time. It is an integrated component and is connected to the emitter.

But this type of control circuit is a source of non-linearities. Furthermore, for a linear or two-dimensional arrangement of microtips, it cannot compensate for dispersions of doses emitted due to current dispersions inherent to microtips.

The purpose of the invention is to compensate for this type of non-linearity so as to make the control device linear and useable, and to provide specific solutions for linear or two-dimensional devices.

PRESENTATION OF THE INVENTION

The invention relates to a switching and controlling device for an electron dose emitted by a micro-emitter, for example a microtip, characterized in that it comprises:

- a sensor module that receives the output current from the micro-emitter and a voltage to adjust the polarization point of the said device,
- a comparator module that receives the output signal from the said sensor module, and a threshold voltage to adjust the quantity of electrons to be emitted,
- a logical module that receives the output signal from the comparator module, and a start signal to initialize the electron emission, and a logical signal to define whether or not the micro-emitter should emit,
- a control module that receives the output signal from the said logical module that generates the voltages necessary for initialization and extinction of the micro-emitter current pulse,
- means of varying the threshold voltage such that the sum $S=N_{start}+N_{measure}+N_{off}$ remains constant during the electron emission, where $N_{start}$ is the number of electrons at the current pulse start time, $N_{measure}$ is the number of electrons at the measurement time of this current pulse, $N_{off}$ is the number of electrons at the extinguishing time of this current pulse.

In a first example embodiment, the device according to the invention comprises means of modulating the threshold voltage in time starting from the initialization signal so as to program a variable dose control in time such that excess electrons emitted during the initialization and extinguishing times are strictly compensated by a reduction of the programmed dose in time.

In a second embodiment, the device according to the invention also comprises:

- a module for detecting the micro-emitter current, capable of reproducing the tip current $I_{tip}$ exactly, or adding a gain on the current,
- a variable voltage generation module that outputs a set voltage $V2=f(I_{tip})$.

The invention also relates to a linear or matrix switching and controlling device for electron doses emitted by a set of micro-emitters, characterized in that it comprises the following for each micro-emitter:

- a sensor module that receives the output current from the micro-emitter and a voltage to adjust the polarization point,
- a comparator module that receives the output signal from the said sensor module and a threshold voltage to adjust the quantity of electrons to be emitted,
- a logical module that receives the output signal from the comparator module, and a start signal to initialize the electron emission, and a logical signal to define whether or not the micro-emitter should emit,
- a control module that receives the output signal from the said logical module that generates the voltages necessary for initialization and extinction of the micro-emitter current pulse,
- means of varying the threshold voltage such that during the electron emission, the sum $S=N_{start}+N_{measure}+N_{off}$ remains approximately constant, where $N_{start}$ is the number of electrons at the current pulse start time, $N_{measure}$ is the number of electrons at the measurement time of this current pulse, $N_{off}$ is the number of electrons at the extinguishing time of this current pulse.

The invention also relates to a process for switching and controlling an electron dose emitted by a micro-emitter comprising:

- a step to convert the current output by the micro-emitter and to adjust the operating polarization point,
- a step to compare the signal obtained at the output from the previous step with a threshold voltage for adjustment of the electron quantity to be emitted,
- a logical step to initialize the electron emission, and to define whether or not the micro-emitter should emit,
- a control step that generates the voltages necessary for initialization and for extinction of the micro-emitter current pulse, characterized in that it comprises a step to vary the threshold voltage such that during the emission of electrons, the sum $S=N_{start}+N_{measure}+N_{off}$ remains constant, $N_{start}$ being the number of electrons at the current pulse start time, $N_{measure}$ being the number of electrons at the measurement time of this current pulse, $N_{off}$ being the number of electrons at the extinguishing time of this current pulse.

This type of invention has a wide field of applications:

- electron emission by cold cathode,
- switching and controlling of weak electric charges,
- compensation of charge measurement errors,
- high operating frequency,
- solution compatible with application specific integrated circuits (ASICs).

BRIEF DESCRIPTION OF THE DRAWINGS

FIGS. 1A and 1B illustrate the electrical scheme and the behavioral symbol of a microtip, respectively, FIG. 2 illustrates the current-voltage characteristics of a microtip, FIGS. 13A and 13B illustrate curves giving the number of electrons relative to the tip current, without using compensation and using active compensation on the current, respectively, FIG. 14 illustrates an example time compensation according to the invention.

DETAILED PRESENTATION OF PARTICULAR EMBODIMENTS

Figure 3A:
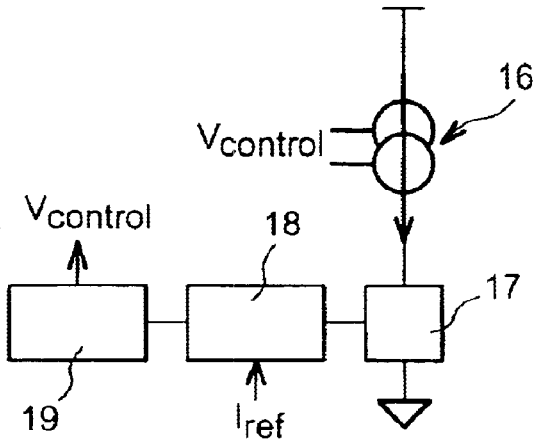
FIGS. 3A and 3B illustrate a current regulation system for an open loop microtip and a closed loop microtip, respectively.
Figure 3B:
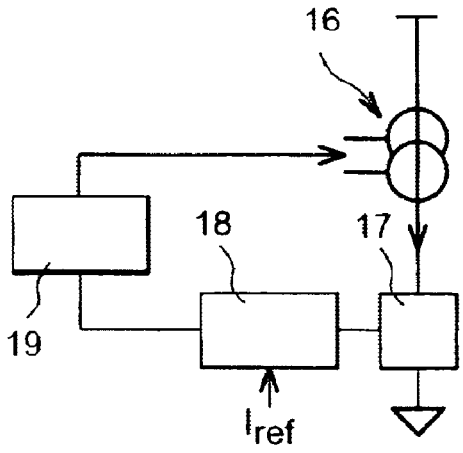
Figure 4:
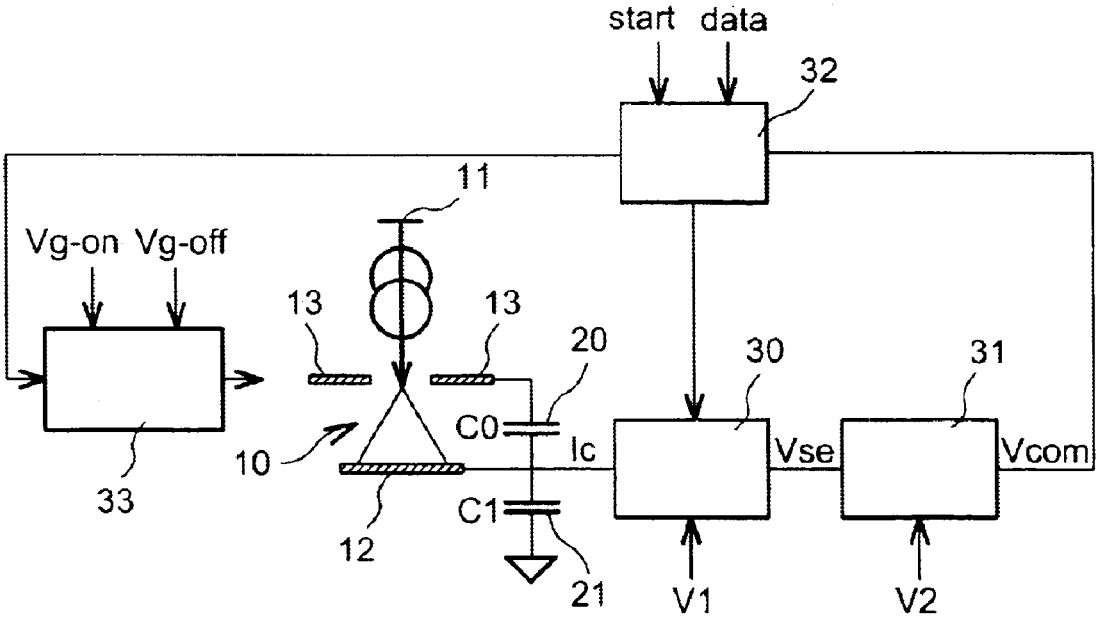
FIG. 4 illustrates a switching and controlling device for an electron dose emitted by a microtip.
Figure 5:
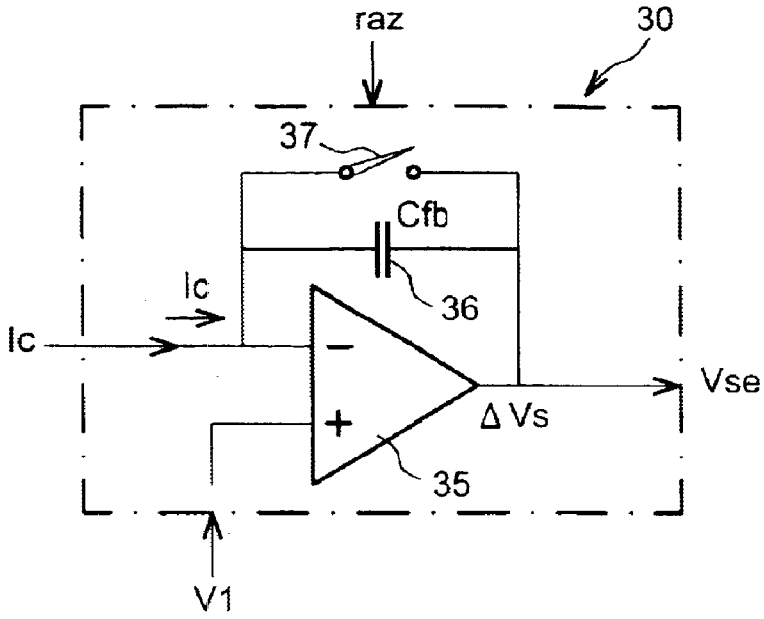
FIG. 5 illustrates the sensor module of the device in FIG. 4.
Figure 6:
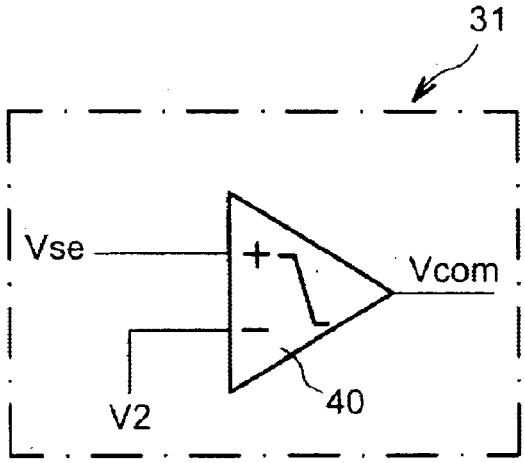
FIG. 6 illustrates the comparator module of the device in FIG. 4, FIGS. 7A and 7B show time diagrams illustrating operation of the device in FIG. 4.

The switching and controlling device of an electron dose emitted by a micro-emitter illustrated in FIG. 4 is composed of a microtip 10 with an anode 11, a cathode 12 and an extraction grid 13, capable of supplying a current when the voltage of the extraction grid 13 relative to the cathode 12 becomes greater than the extraction voltage in the vacuum. Parasite capacitances 20 and 21 are inherent to the fabrication of such a microtip 10 in microtechnology.

This device comprises:

- a sensor module 30 that performs an electron-voltage conversion and that receives the current Ic output by this microtip 10 and a voltage V1 to adjust the polarization point of the said device, the sensitivity of a module $\mathfrak{R}$ being expressed in Volts/electrons,
- a comparator module 31 that receives the output signal Vse from the said sensor module 30 and a threshold voltage V2 to adjust the quantity of electrons to be emitted, and that outputs a sufficient charge detection signal Vcom,
- a logical module 32 that receives this signal Vcom, and a Start signal to initialize the electron emission, and a logical data signal to define whether or not the microtip should emit,
- a control module 33 that receives the output signal from the said logical module 32 and the Vg-on and Vg-off signals that generate the voltages necessary for initialization and extinction of the microtip current pulse (several tens of Volts).

This device is actually applicable to an arrangement of several microtips either in the form of a linear arrangement (strip) or a two-dimensional arrangement (matrix). All combinations of arrangements are also possible. This device can be made using a specific high voltage technology, and can control electron doses emitted at high rates.

We will now analyze each of these modules 30, 31, 32 and 33.

Sensor Module 30

The role of this module 30 is to process the basic information available on the microtip 10 and to convert it into a magnitude that can be compared with an input magnitude, in order to take a decision on the number N of electrons emitted.

This module may advantageously be composed of a CTIA (Capacitive TransImpedance Amplifier) amplifier that makes a current—voltage conversion. The input variable is then the cathode current of the microtip $I_c$. This amplifier is characterized by its conversion gain $\mathfrak{R}$ that is expressed in Volts/$e^-$. It is composed of an amplifier 35, a counter reaction capacitor ($C_{fb}$) 36 and a reset device 37. The result for the output excursion $\Delta V_s$ of the sensor module is:

$$\Delta V_s = \frac{-I_c * T_{int}}{C_{fb}} = \frac{N * q_e}{C_{fb}} = N\mathcal{R}$$

This type of solution is advantageous compared with a solution making a direct integration on the microtip capacitance for several reasons:

- the signal is not sensitive to parasite capacitances on the input side,
- its conversion gain may be fixed precisely. It is defined by the value of $C_{fb}$. For example, it may be 23 μV/$e^-$ for $C_{fb}$=7 fF,
- the cathode polarization point is fixed by the external variable V1.

Comparator Module 31

This module 31 receives two analog voltages on its inputs:

- the output voltage $V_{sc}$ from the sensor module 30,
- the control voltage V2 that fixes the value of the comparison threshold.

This module comprises an amplifier 40 in open loop, for which the output level comprises two states (VDD and VSS) equivalent to two logical states as a function of the input voltages:

- as long as $V_{sc}$>V2, the logical output $V_{com}$ remains equal to "1",
- when $V_{sc}$=V2, the logical output $V_{com}$ switches and is set to a logical "0".

Logical Module 32

This module 32 has several internal signal sequencing and generation functions. Its roles are to:

- latch the decision made $V_{com}$ obtained at the output from the comparator module 31 until the arrival of a reset signal,
- generate non-overlapping phases useful for resetting the sensor module 30 and the control module 33.

This module is initialized by a start signal at the beginning of the sequence, and obeys the data signal as illustrated in the following table:

| Data | Action |
|---|---|
| 1 | Emission from the microtip |
| 0 | No emission from the microtip |

Control Module 33

This module 33 establishes the extraction grid voltage necessary for the microtip to emit the required current synchronously with the appearance of the start signal. When the emitted electron dose has been reached (decision signal Vcom emitted by the comparator module 31), this module 33 cuts off the flow by bringing the extraction grid voltage to a level such that the electron current is reduced by several decades. These ignition and extinguishing values depend on the transconductance of the microtip and its geometric model. Control voltages may be switched from 20 V to about 50 V, which then requires the use of a specific high voltage technology (HVCMOS). The main function of this module 33 is therefore to translate the level [0–3 V] to [20 V–50 V].

This type of switching and controlling device has many limitations, inherent to the principle used. The voltage $V_{se}$ obtained at the output from the sensor module 30 is proportional to the cathode current $I_c$ emitted by microtip. Considering V1 as being the initialization voltage level, the number $N_e$ of electrons emitted by the microtip is such that:

$$N_e = \frac{Q_e}{q} = \frac{(V_{se} - V1)}{\mathcal{R}} \text{ where } \mathcal{R} = \frac{q}{C_{fb}}$$

Qe is the electric charge emitted and q is the charge of the electron.

Therefore, a calibrated charge Qc may be programmed by V2 with the following relation:

$$Nc = \frac{Q_c}{q} = \frac{(V2 - V1)}{\mathcal{R}}$$

Figure 7A:
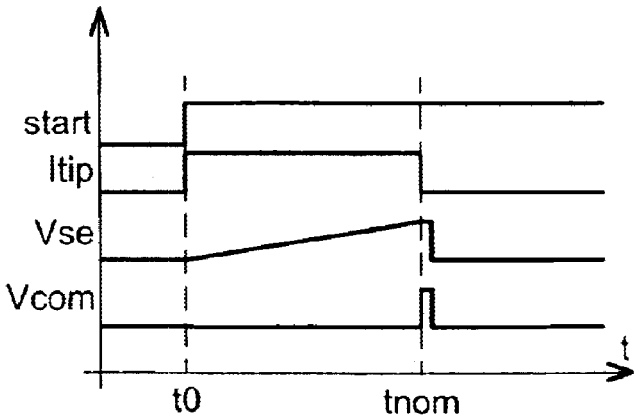
Figure 7B:
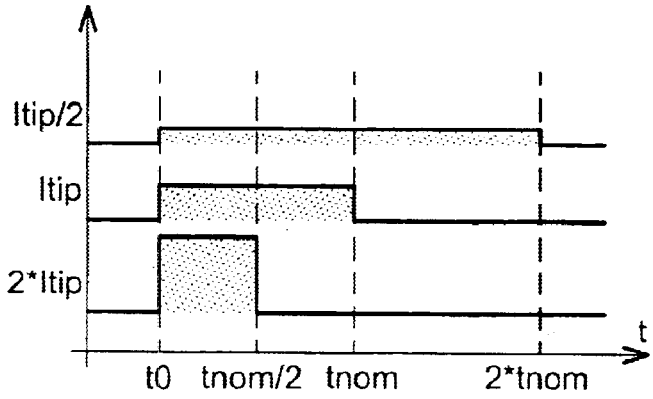

The value of the comparison threshold V2 fixes the programmed electric charge. If all modules were perfect, the sensor module 30 would immediately transmit a representation $V_{se}$ of the cathode current $I_c$, the comparator module 31 would not have any delay, and the extraction grid control would instantaneously activate making or breaking the electron flow, according to the time diagram in FIG. 7A. Regardless of the level of the electron current, the emitted charge would be identical, and as illustrated in FIG. 7B:

- a nominal current $IC_{nom}$ would be interrupted after a certain time $T_{nom}$,
- a current $2*IC_{nom}$ would be interrupted after a time $t_{nom}/2$,
- a nominal current $0.5*Ic_{nom}$ would be interrupted after a time $2*t_{nom}$.

The areas shown in grey in each of the three cases are equal.

In reality, the global duration of the current pulse is not linear as a function of the programmed current level. Due to the parasite capacitances 20 and 21 mentioned above, switching of the extraction grid 13 by several tens of Volts temporarily disturbs the input of the sensor module 30 for which the polarization has to be maintained to prevent saturation. This type of saturation would then require a large time constant before a return to equilibrium and would not enable operation at high frequency. During this time in which polarization of the sensor module 30 is maintained to creation of the electron flow, electron charges are already emitted and need to be counted in the global balance of emitted charges, although they cannot be measured since they depend on the current level that is not known in advance. This type of phenomenon is a first source of non-linearities.

Figure 8:
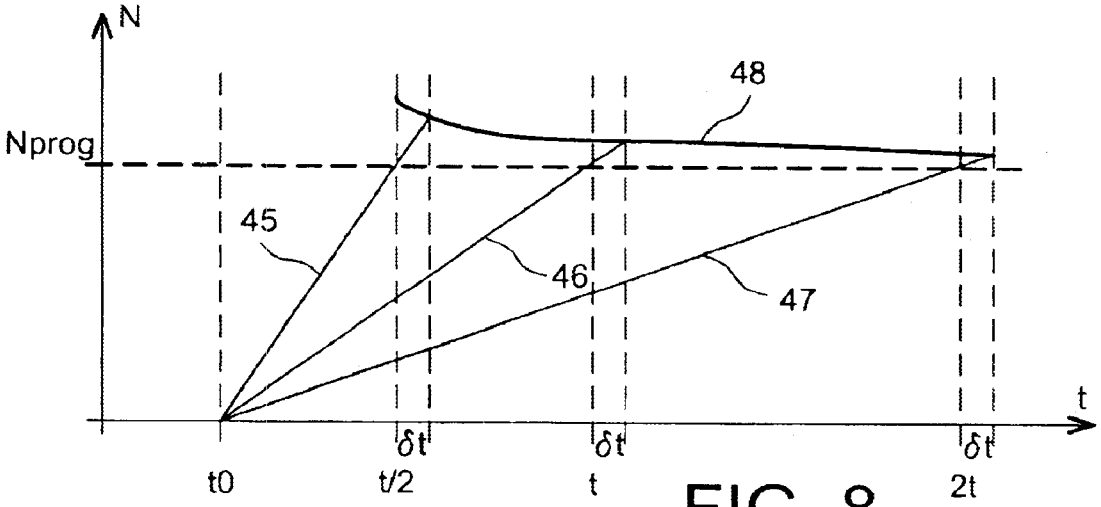
FIG. 8 illustrates a materialization of the error on the number of programmed electrons.

Another phenomenon occurs when the electron beam is extinguished, when $V_{se}$ reaches V2. The comparator module 31 has a delay in making the decision, which is inherent to any electron module. During this delay, the microtip 10 continues to emit and therefore there is an additional extinguishing charge that is added into the global balance of the emitted charges. FIG. 8 shows a materialization of the error on the number N of programmed electrons, and illustrates such a phenomenon. If the number of electrons emitted is plotted as a function of time with respect to the number of programmed electrons, with a constant delay, an error is observed on the number of electrons emitted depending on the current level. In this figure, curve 45 corresponds to 2*Iinom, curve 46 corresponds to Iinom and curve 47 corresponds to Iinom/2, curve 48 corresponds to the number of electrons emitted. Therefore, there is an overshoot on the charge emitted with respect to the programmed charge, which is a second source of non-linearities.

Figure 9:
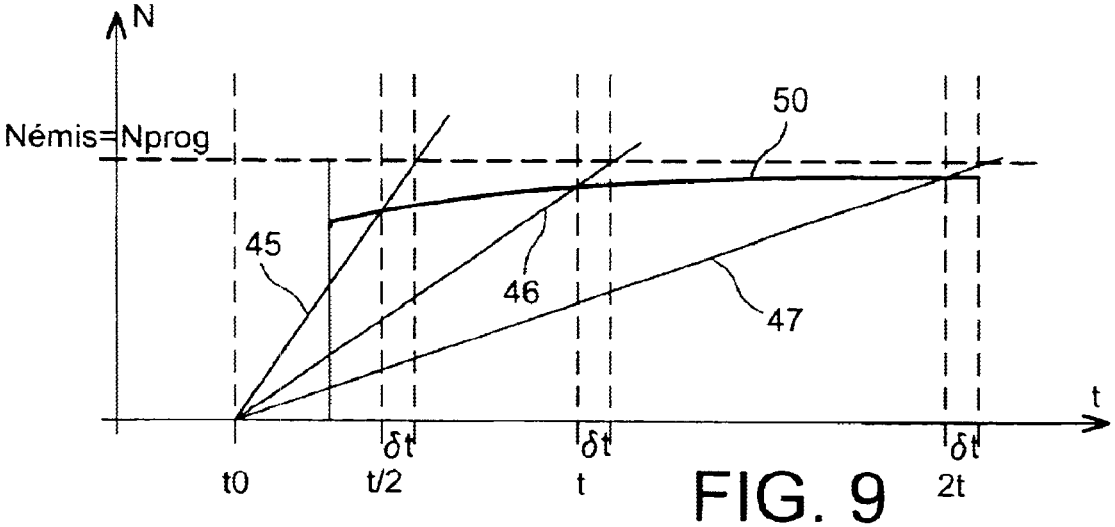
FIG. 9 illustrates error compensation on the number of electrons programmed by variable threshold.
Figure 10:
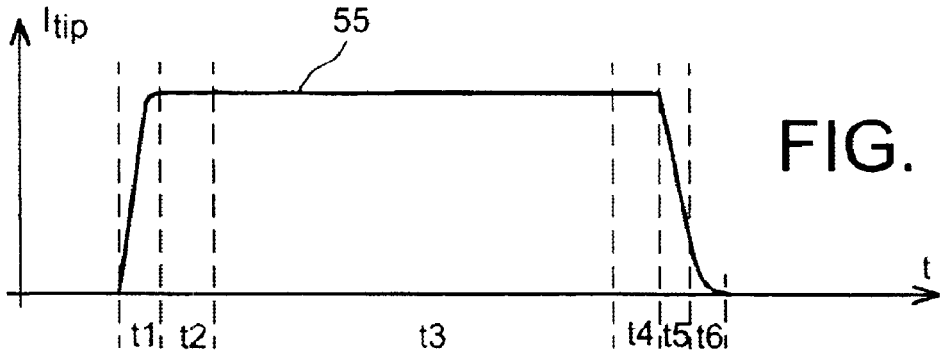
FIG. 10 illustrates the decomposition of a current pulse in elementary times.

A first solution for compensating for such non-linearities uses a comparison threshold that varies as a function of time. To achieve this, all that is necessary is to send a stair-case 50 on the input V2 of the comparator module 31 as illustrated in FIG. 9.

The purpose of the invention is to compensate for such non-linearities by proposing other compensation methods by controlling the cathode current in $I_c$ and by feedback on the value of the threshold V2.

By analyzing the profile 55 of the microtip current pulse, it can be decomposed into a series of elementary times t1 to t6:

- t1: time to set up the voltage Vgate + reset CTIA,
- t2: latching time for the CTIA reset to cancel charge injection effects and transients,
- t3: measurement time,
- t4: comparator decision making delay time,
- t5: delay time due to cutoff of Vgate (logical),
- t6: delay to stop the electron flow.

Some of these elementary times can be grouped together, to give the following simplified model:

- t1+t2=$t_{start}$: initialization time that extends from $t_{début}$ (corresponding to the beginning of the pulse) until $t_{start\text{-}control}$ (corresponding to the effective beginning of the dose control),
- t3=$t_{measure}$: actually controllable measurement time that extends from $t_{start\text{-}control}$ until $t_{start\text{-}control}$ (corresponding to the end of the dose control),
- t4+t5+t6=$t_{off}$: extinguishing time that extends from $t_{end\text{-}control}$ until $t_{fin}$ corresponding to the effective end of the dose emission.

If it is considered that the current reaches its nominal value $I_{steady\text{-}state}$ quickly during the initialization time $t_{start}$ and that it is latched for an extinguishing time $t_{off}$, as a first approximation it is therefore constant during the entire duration of the current pulse. At the beginning, the setup time for $V_{gate}$ is short and at the end, logical and extinguishing delays for $V_{gate}$ are largely dominated by the delay of the comparator module 31 when the decision is being made.

The total dose emitted as a number of electrons can be expressed as follows:

$$N_{beam} = N_{measure} + \frac{I_{steady\text{-}state} * (t_{start} + t_{off})}{q_e}$$

where $$N_{measure} = \frac{(V_2 - V_1)}{\mathcal{R}} \text{ where } \mathcal{R} = q_e / Ctia$$

Figure 12:
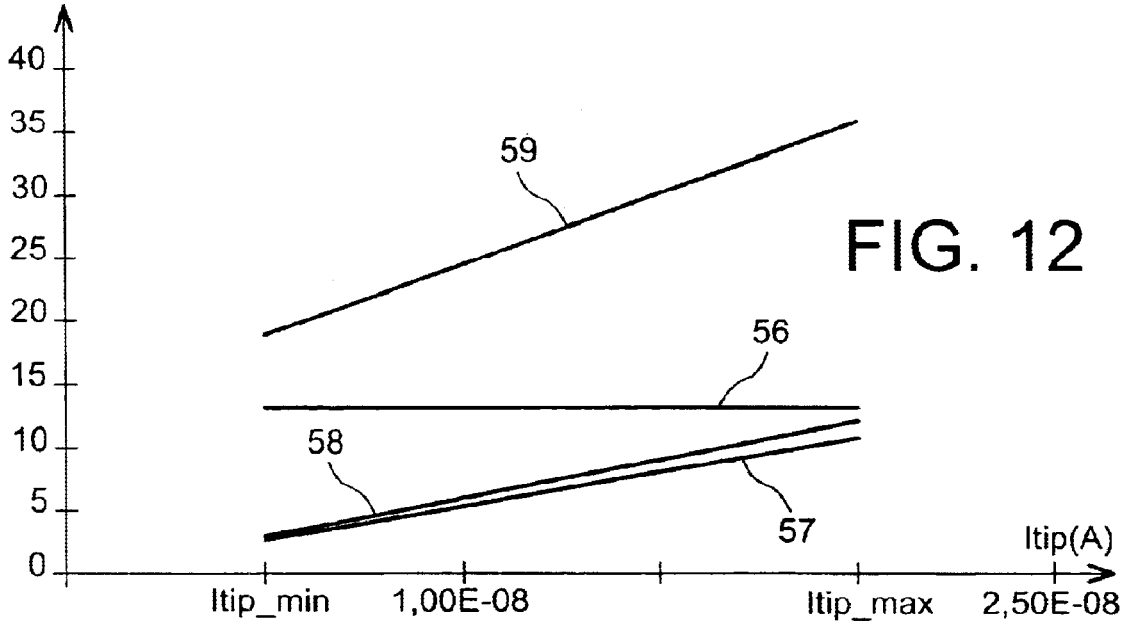
FIG. 12 illustrates the distribution of doses during the different elementary times.

The predicted electron dose is fixed by $N_{measure}$, but in fact an excess dose can be added due to non-zero start and extinguishing times. FIG. 12 illustrates a curve showing the number of electrons emitted as a function of the current state.

In theory, as mentioned above, the number of electrons emitted should remain the same regardless of the current $I_{tip}$, as illustrated by the horizontal curve 56.

Curves 57 and 58 illustrate the number of electrons emitted during the initialization and the extinguishing times respectively. The sequencing may be such that the times $t_{start}$ and $t_{off}$ remain constant regardless of the current, in other words the electrons emitted during these times $t_{start}$ and $t_{off}$ only depend on the current state (affine function).

The number of emitted electrons appears on the curve 59 which, for any value of the abscissa X, represents the sum of the curves 56+57+58.

The relative numeric indication obtained from these curves shows an error on the number of electrons emitted with respect to the set value by a factor of 1.3 to 2.6. This is not acceptable for the required emission control precision.

The purpose of the device according to the invention is to be capable of precisely emitting a programmed number of electrons regardless of the current state of the microtip and to interrupt the electron beam as soon as this value has been reached. Therefore the sum of electrons emitted during each of the times described above must remain constant, i.e., the total number of electrons emitted must be linear and constant regardless of the tip current $I_{tip}$.

The law for variation of the number of electrons emitted during the initialization and extinguishing times for the current pulse (affine function) is known. Therefore, it is possible to act on the test of the number $N_{measure}$ of electrons effectively measured such that the sum $S=N_{start}+N_{measure}+N_{off}$ remains constant. In fact, $N_{measure}$ therefore needs to decrease when $I_{tip}$ increases.

To achieve this, the value of the threshold detection voltage V2 is modified during the electron exposure. Compensation is made on excessive electron quantities satisfying the following law:

$$\frac{I_{tip} * t}{q_e}$$

Two types of compensation are possible: a time compensation or a compensation as a function of the current. FIGS. 13A and 13B illustrate theoretical curve 60 and measured curve 61 respectively, and theoretical curve 60 and measured curves 61' of the relative number of electrons as a function of the tip current $I_{tip}$ respectively, without compensation and with compensation respectively, as a function of the current. Curve 61' demonstrates the improvement to be obtained by using such an active compensation as a function of the current.

FIG. 13B shows the stability of the number of electrons emitted as a function of the tip current, although there is an offset that remains inherent to the method used. The time denoted $t_{measure}$ cannot be zero since in this case nothing would be tested. The minimum time necessary for the compensation to work correctly must be such that the noise added by the sensor module 30 remains weak compared with the signal being processed by this module (typically $N_{offset}$= 400 electrons, or $\Delta V_{S_min}$=8 mv).

The invention also relates to a linear or matrix switching and controlling device for electron doses emitted by a set of micro-emitters, that comprises different modules 30, 31, 32 and 33 and means of varying the threshold voltage as described above, for each micro-emitter.

EXAMPLE EMBODIMENTS

Time Compensation

This type of compensation is illustrated in FIG. 14. It does not cover all needs. It is capable of compensating for disparities between microtips, but not high frequency fluctuations on the same microtip. However, it can be used as soon as it is certain that the recurrence frequency of current fluctuations is less than the frequency of appearance of the programmed pulses. The threshold voltage V2 is modulated in time starting from the start signal so as to program a dose control variable in time such that excess electrons emitted during the $t_{start}$ and $t_{off}$ phases are precisely compensated by the reduction of the programmed dose with time.

$$\text{Programmed dose} = N_{prog} = \frac{|(V2(t) - VI)|}{\mathcal{R}} \text{ where } \mathcal{R} = \frac{q_e}{C_{tia}}$$

This time variation is controlled by the generator 65.

Active Compensation as a Function of the Current

When the frequency of current fluctuations is such that the current can vary for an elementary exposure time, the previous time correction is no longer sufficient. In the expression of the balance of the number of electrons emitted:

$$N_{e^-} = \frac{I_{tip} * T}{q_e}$$

The two variables $I_{tip}$ and T vary simultaneously during the test. Therefore, it is no longer possible to test one of the variables while measuring the other. An active correction is necessary as a function of the current.

Figure 15:
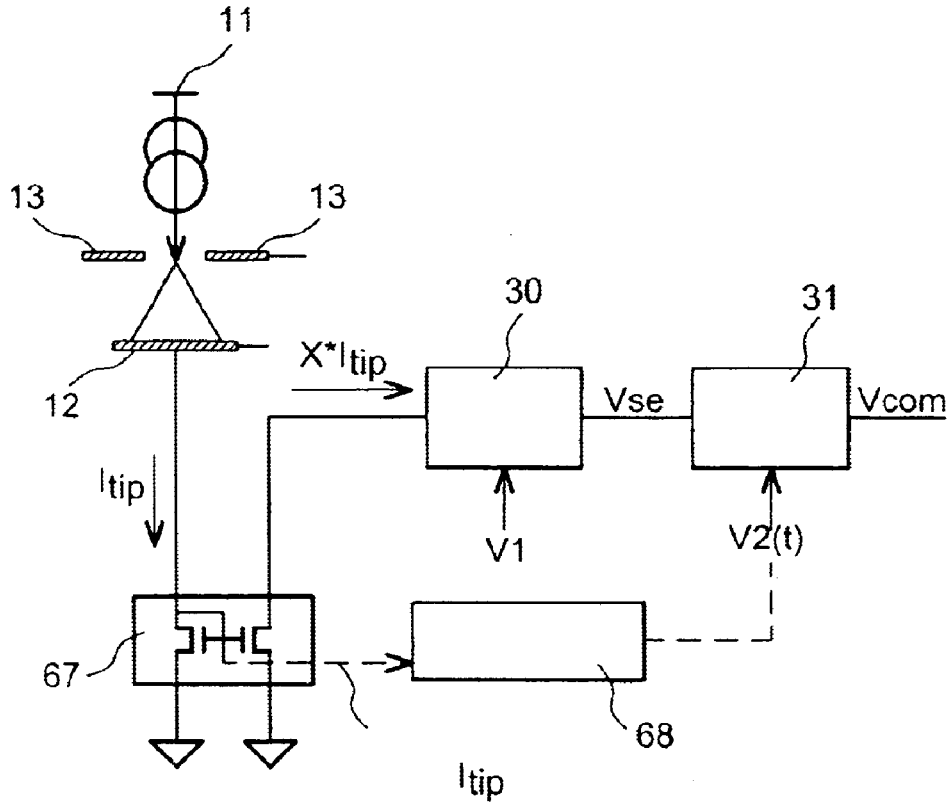
FIGS. 15 and 16 illustrate a simplified compensation scheme as a function of the tip current according to the invention.

FIG. 15 illustrates a simplified compensation diagram as a function of the tip current. A tip current detection module 67 is capable of precisely reproducing the tip current or introducing a gain (X) on this current, for example using a current mirror. This output current is measured by the sensor module 30. The input current Itip is also used as a reference for the variable voltage generation module 68 that outputs a set voltage V2=f($I_{tip}$). The decision on the time is always taken by the comparator module 31, but the decision threshold V2 is indexed on the instantaneous value of the emission current. The result is thus optimum compensation.

Figure 11:
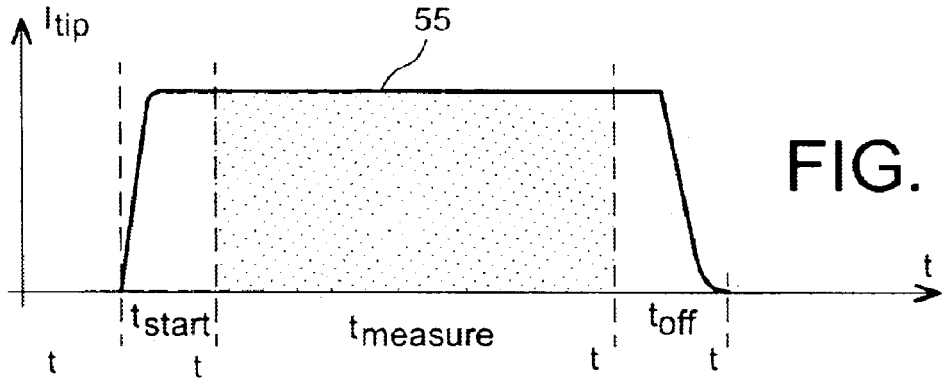
FIG. 11 illustrates a decomposition that is simpler than that illustrated in FIG. 10.

More precisely, using the same notations as in FIG. 11, the number of electrons emitted in each of the phases can be calculated:

Initialization phase $$N_{start} = q\frac{I * (t_{\text{début_contrôle}} - t_{\text{début}})}{q}$$

Measurement phase $$N_{measure} = q\frac{I*(t_{\text{fin_contrôle}} - t_{\text{début_contrôle}})}{q}$$

Extinction phase $$N_{stop} = q\frac{I*(t_{fin} - t_{\text{fin_contrôle}})}{q}$$

The number of electrons deposited in excess to be compensated by modifying the voltage V2 is equal to:

$$N_{start} + N_{stop} = \frac{I}{q}\left[(t_{\text{début_contrôle}} - t_{début}) + (t_{fin} - t_{\text{fin_contrôle}})\right] = \frac{I}{q}\left[t_{start} + t_{off}\right]$$

Hence as a function of ΔV2:

$$N_{start} + N_{stop} = \frac{C*\Delta V2}{q} \quad \text{namely} \quad \Delta V2 = \frac{I}{C}\left[t_{start} + t_{off}\right]$$

Since the capacitance of the sensor block and times $[t_{start}+t_{off}]$ are known, the variation of V2 to be programmed is directly proportional to I. The voltage difference to be programmed with respect to Vref (voltage to be applied to obtain the required dose during the measurement phase if Nstart and Nstop did not exist), can therefore be used, for example using a resistance $R_L$ to set up a voltage $R_L$*I, where $R_L=(t_{start}+t_{off})/C$. In the special case in which the CTIA amplifier is recharged to a high state, this voltage $R_L$*I must be added to the voltage Vref to stop supply the microtip and therefore its emission, more quickly than in the ideal case (without Nstart and Nstop).

Figure 16:
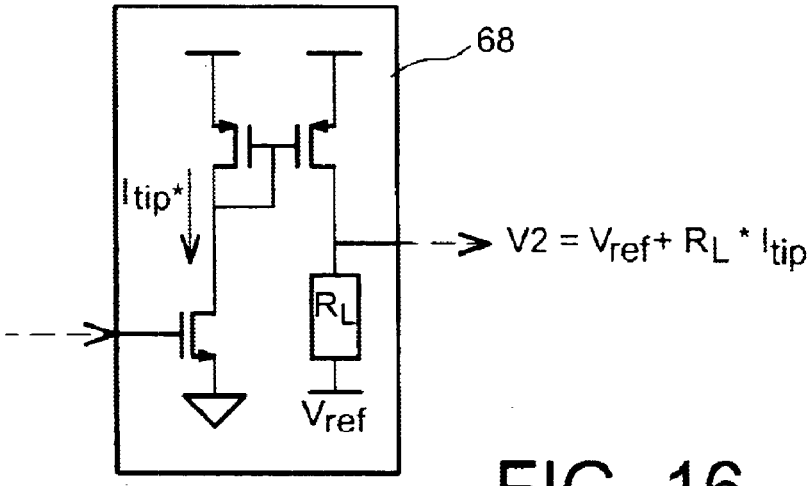

For example, the block 68 in FIG. 15 can then be made as illustrated in FIG. 16.

The transistor dimensions are chosen to satisfy the specified function in a manner known by those skilled in the art.

This type of embodiment is advantageous in the sense that it enables carrying out all required functions close to or in the electron emission site, which has several advantages:

- it individually compensates for non-uniformities in emission of microtips or any other device,
- it performs these various functions in an ASIC (Application Specific Integrated Circuit),
- consequently, it participates in improving production efficiencies of microtips and their life,
- it is directly possible to access large two-dimensional emitters without making the various peripheral interfaces more complex (automatic processing of the in-pixel signal).

References

[1] "Structure optimisation of transistor-based Si field emitter arrays" by T. Matsukawa, K. Koge, S. Kanemaru, H. Tanoue and J. Itoh (TIDW'98, pages 671–674, FED 2–4)

[2] "Active matrix field-emitter arrays for the next-generation FEDs" by J. Itoh, S. Kanemaru, T. Matsukawa (199, SID)

[3] U.S. Pat. No. 6,392,355 B1

[4] "Digital electrostatic electron-beam array lithography" by L. R. Baylor, D. H. Lowndes, M. L. Simpson, C. E. Thomas, M. A. Guillorn, V. I. Merkulov, J. H. Whealton, E. D. Ellis, D. K. Hensley, A. V. Melechko (J.Vac.Sci.Technol. B20 (6), November-December 2002, pages 2646–2650)

What is claimed is:

1. Device for switching and controlling an electron dose emitted by a micro-emitter, characterized in that it comprises:

a sensor module that receives the output current from the micro-emitter and a voltage to adjust the polarization point of the said device, a comparator module that receives the output signal from the said sensor module, and a threshold voltage to adjust the quantity of electrons to be emitted, a logical module that receives the output signal from the comparator module, and a start signal to initialize the electron emission, and a logical signal to define whether or not the micro-emitter should emit, a control module that receives the output signal from the said logical module that generates the voltages necessary for initialization and extinction of the micro-emitter current pulse, means of varying the threshold voltage such that the sum $S=N_{start}+N_{measure}+N_{off}$ remains substantially constant during the electron emission, where $N_{start}$ is the number of electrons at the current pulse start time, $N_{measure}$ is the number of electrons at the measurement time of this current pulse, and $N_{off}$ is the number of electrons at the extinguishing time of this current pulse.

2. Device according to claim 1, comprising means of modulating the threshold voltage (V2) in time starting from the initialization signal (start) so as to program an electron dose control that is variable in time such that excess electrons emitted during the start ($t_{start}$) and extinguishing ($t_{off}$) times are strictly compensated by a reduction of the programmed dose in time.

3. Device according to either claim 1 or 2, comprising:

a module for detecting the micro-emitter current, capable of reproducing the tip current $I_{tip}$ exactly, or adding a gain on the current, a variable voltage generation module (68) that outputs a set voltage $V2=f(I_{tip})$.

4. Device according to claim 3 in which the micro-emitter is a microtip.

5. Device according to claim 2 in which the micro-emitter is a microtip.

6. Device according to claim 1 in which the micro-emitter is a microtip.

7. Linear or matrix switching and controlling device for electron doses emitted by a set of micro-emitters, characterized in that it comprises the following for each micro-emitter:

a sensor module that receives the output current from the micro-emitter and a voltage to adjust the polarization point, a comparator module that receives the output signal from the said sensor module and a threshold voltage to adjust the quantity of electrons to be emitted, a logical module that receives the output signal from the comparator module, and a start signal to initialize the electron emission, and a logical signal to define whether or not the micro-emitter should emit, a control module that receives the output signal from the said logical module that generates the voltages necessary for initialization and extinction of the micro-emitter current pulse, means of varying the threshold voltage such that during the electron emission, the sum $S=N_{start}+N_{measure}+N_{off}$ remains substantially constant, where $N_{start}$ is the number of electrons at the current pulse start time, $N_{measure}$ is the number of electrons at the measurement time of this current pulse, $N_{off}$ is the number of electrons at the extinguishing time of this current pulse.

8. Device according to claim 7 in which the micro-emitter is a microtip.

9. Process for switching and controlling an electron dose emitted by a micro-emitter comprising:

a step to convert the current output by the micro-emitter and to adjust the operating polarization point, a step to compare the signal obtained at the output from the previous step with a threshold voltage for adjustment of the quantity of electrons to be emitted, a logical step to initialize the electron emission, and to define whether or not the micro-emitter should emit, a control step that generates the voltages necessary for initialization and for extinction of the micro-emitter current pulse, characterized in that it comprises:

a step to vary the threshold voltage (V2) such that during the emission of electrons, the sum $S=N_{start}+N_{measure}+N_{off}$ remains approximately constant, $N_{start}$ being the number of electrons at the current pulse start time, $N_{measure}$ being the number of electrons at the measurement time of this current pulse, $N_{off}$ being the number of electrons at the extinguishing time of this current pulse.

10. Process according to claim 9, comprising a step in which the threshold voltage (V2) is modulated with time starting from the initialization signal (start) so as to program an electron dose control that is variable in time such that excess electrons emitted during the start ($t_{start}$) and extinguishing ($t_{off}$) times are all or partly compensated by a reduction of the programmed dose in time.

11. Process according to claim 9, comprising:

a step for detecting the tip current, capable of reproducing the tip current $I_{tip}$ exactly, or adding a gain on the current, a step to generate a variable voltage (68) that outputs a set voltage $V2=f(I_{tip})$.

* * * * *